US005517176A

United States Patent [19]

Lavelle et al.

[11] Patent Number: 5,517,176

[45] Date of Patent: May 14, 1996

[54] EMERGENCY EXIT BAR WITH DUAL SENSORS

[75] Inventors: Gary E. Lavelle, Avon; George Frolov, Farmington; George A. Baehr, Bristol, all of Conn.

[73] Assignee: Harrow Products, Inc., Grand Rapids, Mich.

[21] Appl. No.: 384,787

[22] Filed: Feb. 6, 1995

[51] Int. Cl.[6] ..... G08B 21/00

[52] U.S. Cl. ..... 340/542; 49/25; 70/92; 292/92; 340/521; 340/540; 340/556; 340/562

[58] Field of Search ..... 340/542, 556, 340/562, 540, 521; 49/25, 31; 70/92; 292/92

[56] References Cited

U.S. PATENT DOCUMENTS

| | | | |
|---|---|---|---|
| 4,006,471 | 2/1977 | Pappas | 70/92 |
| 4,763,937 | 8/1988 | Sittnick, Jr. et al. | 292/251.5 |
| 4,804,945 | 2/1989 | Millet | 340/562 |
| 4,831,279 | 5/1989 | Ingraham | 340/562 |
| 4,893,852 | 1/1990 | Harris et al. | 292/251.5 |
| 4,961,330 | 10/1990 | Evans | 292/92 |
| 5,027,552 | 7/1991 | Miller et al. | 49/31 |

*Primary Examiner*—Glen Swann
*Attorney, Agent, or Firm*—Chilton, Alix & Van Kirk

[57] ABSTRACT

An exit bar has an elongated body for mounting on an exit door. The exit bar incorporates a pair of independent sensors. An infrared beam is generated along the front of the bar. An infrared detector produces a first signal when the beam is interrupted. The first signal results in release of a lock securing the door. If the beam is interrupted for longer than a pre-set time limit, a first alarm sounds. A capacitance sensor produces a second signal when the sensor detects changes of capacitance in the bar as a result of contact or near contact with foreign objects. The second signal also results in release of the lock securing the door. If the capacitance sensor detects a capacitance change for longer than a pre-set time limit, a second alarm sounds.

20 Claims, 4 Drawing Sheets

EMERGENCY EXIT BAR WITH DUAL SENSORS

BACKGROUND OF THE INVENTION

This invention relates to the field of door security systems. More specifically, this invention relates to the use of exit or panic bars for the emergency egress through a doorway.

Exit bars which allow egress through a doorway during normal and emergency situations are well known in the art of door security systems. Conventional exit bars typically employ a mechanical movement to operate a latch mechanism. This mechanical movement which triggers unlocking of a door results from a force exerted on the exit bar by a person attempting to egress through the doorway. With the increasing use of electromagnetic locks or electrically actuated mechanical locks, exit bars for such locks are responsive to a contact force on the exit bar to actuate an electrical switch which causes the lock to release. Mechanical exit bars, whether directly operating latches or actuating switches to operate electrical locks, typically have the same problems. A mechanical exit bar is subject to wear of the components and to the possibility of becoming jammed. An exit bar jammed in a permanent unlocked state is a risk to security by allowing unauthorized entrance from the outside. An exit bar jammed in a permanent locked state can have catastrophic safety consequences.

As a response to some of the deficiencies of mechanical exit bars, bars which are sensitive to capacitance changes for controlling the operation of electromagnetic locks have been employed. Capacitance sensitive bars, however, can fail if the sensitivity of the electronics is improperly adjusted or changes during operation. In addition, insufficient capacitance change may not be a reliable indicator of a person wanting to egress under all circumstances, for example, when the bar is contacted by an insulated material such as a glove or a coat.

SUMMARY OF THE INVENTION

Briefly stated, the invention in a preferred form is an electronic emergency exit bar for the actuation of an electromechanical or electromagnetic lock. The exit bar maintains the general appearance of a traditional mechanical exit bar so as to assure users of its function. In the preferred embodiment, the exit bar of the invention incorporates two redundant sensor systems to determine when a person is attempting an egress through a secured door.

The first sensor system employs an infrared beam traversing along the front face of the exit bar. An infrared emitter is located at one end of the exit bar and an infrared sensor is positioned at the opposite end of the bar to receive the infrared beam from the emitter. Any object interrupting the infrared beam triggers the sensor system thereby sending a signal to the lock operator to release the electromechanical or electromagnetic lock.

The second sensor system employs a capacitance change sensor. The exit bar of the invention is constructed of an electrically conductive material. Conductively connected to the exit bar is a sensor which detects changes in the capacitance. When a person comes into contact or close proximity with the exit bar, the capacitance of a capacitance circuit will increase and trigger the sensor to send a signal to the lock operator to release an electromechanical or electromagnetic lock.

An exit bar of the preferred embodiment of the invention enhances security and reliability because of the utilization of two independent sensor systems. Contact or near contact on the front of the bar results in at least one sensor system signaling the lock operator to release the lock.

The absence of any required mechanical movement results in a more reliable emergency exit system. Since the sensor components are not subject to typical mechanical wear, the system has a higher rate of reliability and longevity. Failure due to jamming of mechanical components is of no concern. Additionally, this system may be efficiently configured in a manner that, should an electrical failure occur, the electromechanical or electromagnetic lock will be automatically released to allow emergency egress through the doorway—even during a power outage.

It is an object of the invention to provide a new and improved reliable exit bar which is not subject to mechanical jamming.

It is another object of the invention to provide a new and improved exit bar which incorporates a pair of independent redundant sensor systems.

It is a further object of the invention to provide a new and improved exit bar capable of reliably unlocking a door with minimal contact on the bar.

Other objects and advantages of the invention will become apparent from the drawings and the specification.

DETAILED DESCRIPTION OF THE PREFERRED EMBODIMENT

Figure 5:
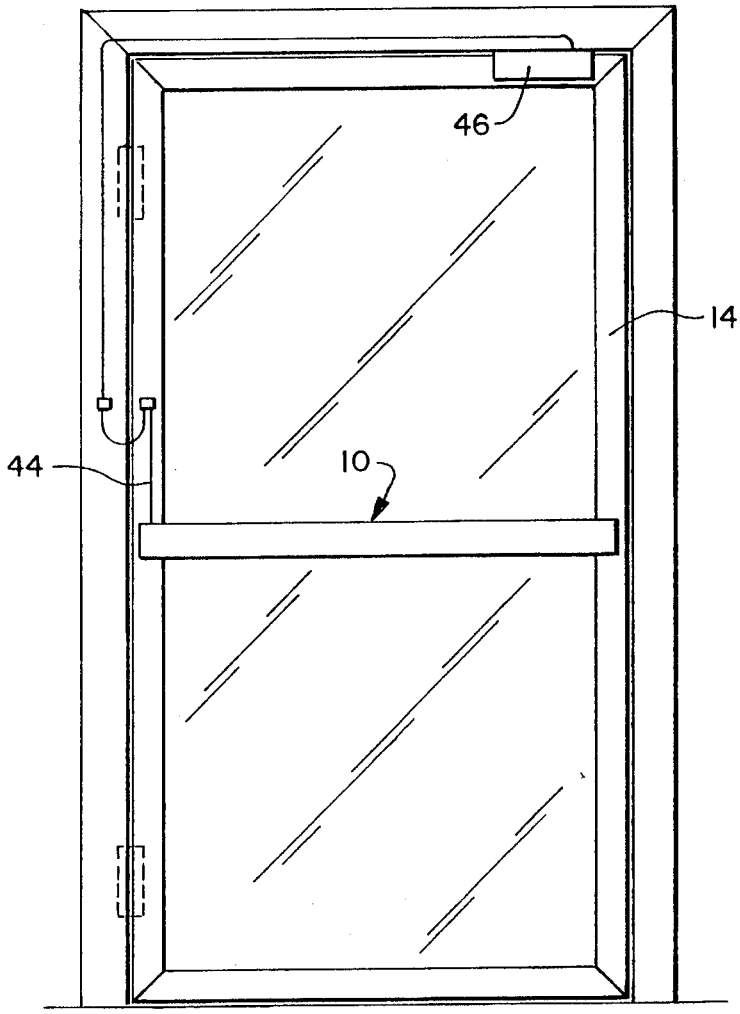
FIG. 5 is a front view, partly in schematic, of the emergency exit bar of FIG. 1 with an associated door, doorway and lock system.

With reference to the drawings wherein like numerals represent like parts throughout the figures, an emergency exit bar of the invention is generally represented by the numeral 10. In a preferred environment, the exit bar 10 is mounted to exit door 14 (FIG. 5). The exit bar 10 operates to sense an individual attempting to exit through door 14 and effect a release of a lock such as electromagnetic lock 46.

The exit bar 10 comprises a tubular main body 12 which has a D-shaped cross section and is of sufficient length to extend across substantially the entire width of the door 14. The main body 12 is manufactured from electrically conductive material but may be finished or coated with a non—conductive material. The main body 12 is preferably formed from aluminum and anodized to resist corrosion. The electrically conductive body 12 is mounted to the door 14 by means of insulated mounting blocks 16 positioned at opposite end locations of the body 12. The blocks 16 are required to be insulated when the bar is mounted on a conductive door for proper capacitance sensor function. The body 12 is affixed to the mounting blocks by screws 18.

Affixed to each end of the main body 12 are end cap assemblies 20. Each end cap assembly comprises an infra-red emitter or sensor support 22 and an end plate 24. At each end, a screw 26 extends through the end plate 24, through holes 28 in the sensor support, and into a central support groove 30 cast into the length of the body 12.

A printed circuit board 32 spans the width and partial length of the body 12 to act as a mounting panel for some of the circuitry and components 33 (illustrated schematically in FIG. 1) as will be described below. The circuit board 32 is affixed to the sensor support 22 by means of a screw 34 threaded into the sensor support 22. Additionally, circuit board 32 is affixed to the back of the body 12 by means of internal support block 36. A screw 38 is threaded into one end of the conducting block 36 and a screw 40 is countersunk into the back of the body 12 and threaded into the opposite end of each internal support block 36.

Figure 6:
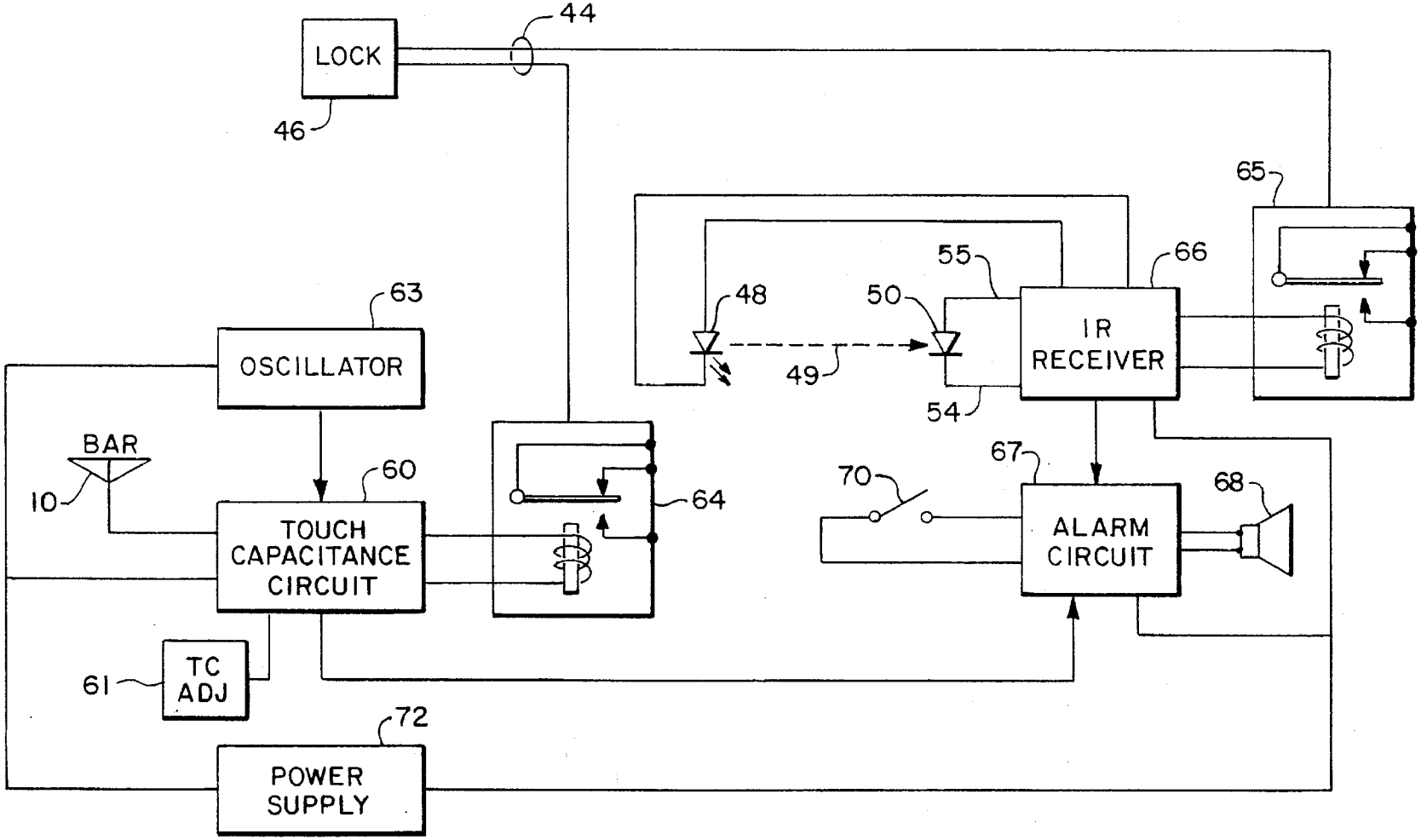
FIG. 6 is a schematic block diagram of the electronics of the exit bar of FIG. 5.

A signal cable passage 42 for the signal cable 44 extends through one of the mounting blocks 16. In the preferred embodiment of the invention, signal cable 44 carries signals from the emergency exit bar 10 which are supplied by relays 64 and 65 (FIG. 6). The relays when activated by the sensor systems release an electromagnetic lock. The lock controller controls the operation of the associated electromagnetic lock 46 or other locking mechanism (not illustrated).

The lock 46 is responsive through the relays 64, 65 to a capacitance sensor unit and an independent redundant infra-red sensor unit located at the emergency exit bar 10. Preferably all the electronics including relays 64, 65 of the exit bar sensors are located on circuit board 32. The signal cable 44 brings power to the exit bar circuits and carries signals from the relays to the lock controller 62.

A capacitance sensing circuit 60 detects changes in the capacitance of the emergency exit bar 10. In the preferred embodiment of the invention, the body 12 and end cap portions 20 are all constructed of a conductive material. The capacitance sensing circuit employs an oscillator 63 to determine changes in the capacitance of the cavity defined by the tubular body 12 of the bar 10. When a person wishing to exit through the doorway on which the emergency exit bar 10 is in close proximity or touches the emergency exit bar 10, the capacitance of the bar will increase. The sensing circuit 60 senses the changing capacitance and signals the lock controller 62 through the relay 64. A flip flop circuit or switch changes state so that a signal is applied to the single pole, double throw relay 64 which activates the lock 64 to allow egress through the doorway. The capacitance sensor 60 has a sensitivity adjustment 61 which is adjustable to prevent releasing the lock for capacitance changes below a preset level.

Figure 1:
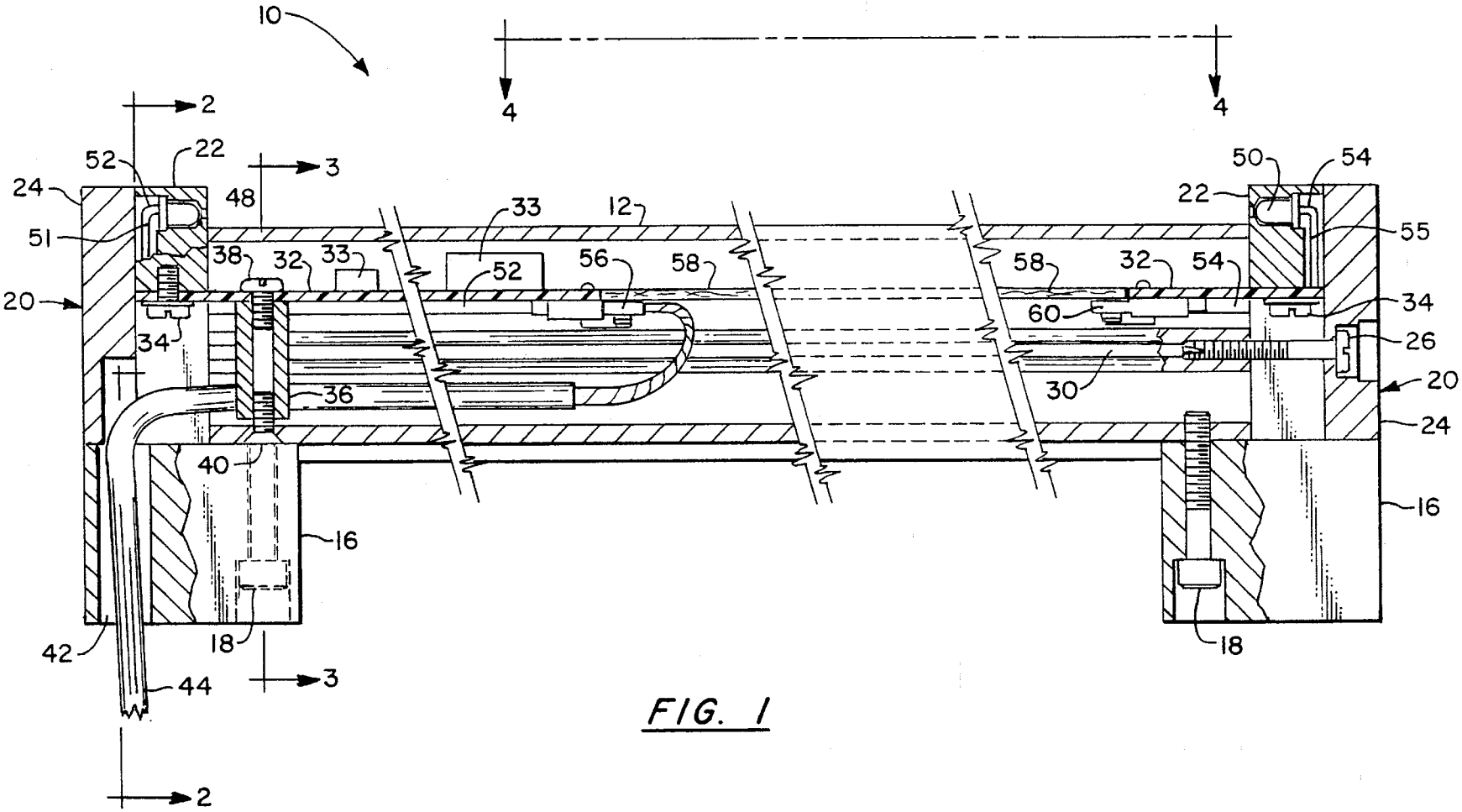
FIG. 1 is a longitudinal sectional view, partly broken away, of an emergency exit bar of the invention.
Figure 2:
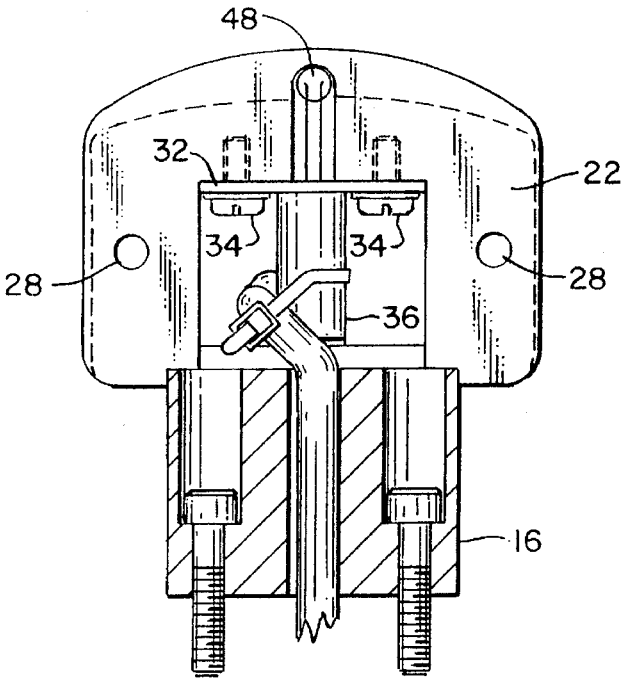
FIG. 2 is an interior cross-sectional view of the emergency exit bar of FIG. 1 taken along the line A—A thereof.
Figure 3:
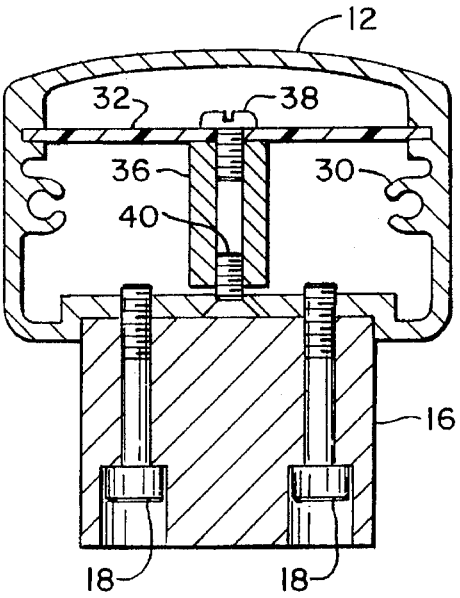
FIG. 3 is an interior cross-sectional view of the emergency exit bar of FIG. 1 taken along the line B—B thereof.
Figure 4:
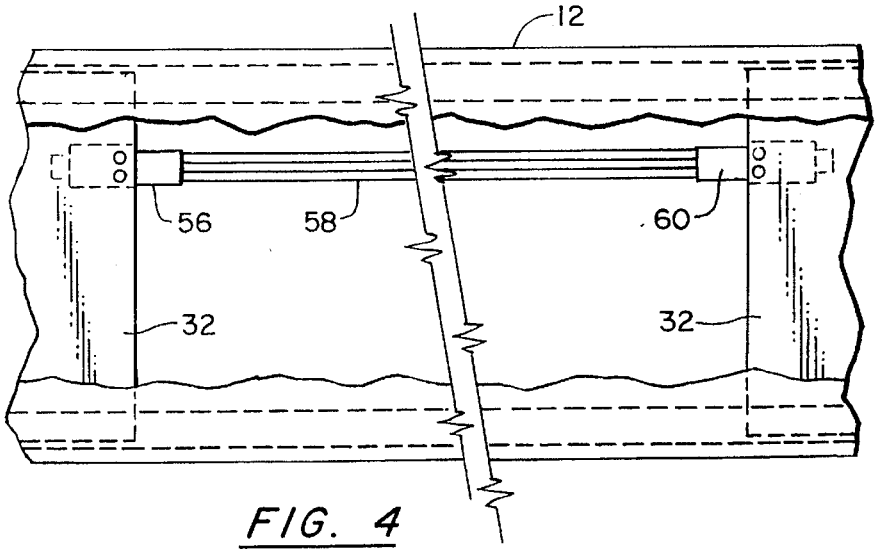
FIG. 4 is an enlarged fragmentary view, partly broken away and partly in phantom, of the emergency exit bar of FIG. 1 taken along the line C—C thereof.

The second sensor system employs an ultra high power infrared LED 48 located in one sensor support 22 (on the left in FIG. 1). A preferred model of a suitable infrared LED is a Stanley DN305. The LED emits an infrared beam 49 that travels the length of and parallel to the body 12 forwardly from the front face. The beam 49 is received by a photo IC 50 located in the other sensor support 22. The photo IC 50 is capable of detecting interruption of the beam under strong background light circumstances. Preferred photo ICs suitable for such conditions are the Hamamatsu light modulation photo receiver of the S4282 series and the S4285 series. The photo emitter 48 is connected to an infrared receiver circuit 66 by signal lines 51, 52. The photo receiver 50 is also connected to the infrared receiver circuit 66 by means of signal lines 54, 55. When the beam between the photo emitter 48 and the photo receiver 50 is interrupted, a signal is applied to activate the relay 65. The relay signals the lock 46 to release via cable 44. The beam interruption thus releases the electromagnetic lock 46 to allow egress through the doorway.

While an infra-red photo system is preferred, other types of sensor systems defining a detection beam traversing across the front of the bar can be employed. Such other sensors may employ beams outside the infrared range or acoustical beams.

The dual sensor systems provide a reliable redundant sensing function. Under normal circumstances, the capacitance sensing circuit will sense contact or near contact anywhere on the exposed surfaces of the emergency bar and release the electromagnetic lock 46. However, under some circumstances, should the bar be contacted by an insulated material, the capacitance of the bar may not significantly change and the lock may fail to release. The photo beam across the front of the body 12 will actuate the lock whenever the beam is interrupted by someone wishing to egress through the doorway. Should contact or near contact occur anywhere on the emergency exit bar to change the capacitance of the bar or the photo beam be interrupted, the two independent sensors combine to allow release of the doorway lock. It should be recognized that either sensor may independently signal the lock to release. Both sensors need not be simultaneously activated to effectuate a release of the lock 46.

Signal cable 44 is mounted to support plate 32 by means of an electrical connector 56. Signals are transmitted along the length of the bar 12 via a flexible internal electrical cable 58 to a second electrical connector 60 connected to the photo receiver 50 by line 54. Preferably, the maximum possible length between the two end portions can be accommodated by the cable 58. Therefore, an emergency exit bar of any suitable length can be constructed essentially by simply fixing the length of the body 12 without any other dimensional adjustments to wiring or other components.

In the preferred embodiment of the emergency exit bar, an alarm circuit 67 (FIG. 6) is integrated into the exit bar circuitry. Continual activation of either sensor system results in the activation of an audible alarm 68. The sound characteristics of each alarm can be specific to the sensor that is being activated. In the preferred embodiment, if the capacitance sensor 60 is activated for more than 15 seconds, a beep of three signals per second indicates the activated condition. Should the infrared photo beam be interrupted for more than 15 seconds, a faster beep cycle of six signals per second indicates the infrared system is activated. Therefore, should there be a malfunction in the system such that one of the sensors is continually activated, the alarm circuit 67 by means of alarm 68 can identify and readily indicate to the appropriate personnel the malfunction. The alarm 68 may also indicate that the background or sensitivity adjustments for the infrared sensor and the capacitance sensor are not properly adjusted. The alarm circuit 67 can also be triggered by an auxiliary switch 70 to attract security personnel to the site of the doorway.

All of the circuits of the exit bar are preferably energized by means of an external power supply 72. The exit bar may also be configured to provide for either a fail-safe or fail-secure operating mode.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. An emergency exit bar comprising:

an elongated tubular body having opposite first and second end assemblies;

beam generator means for generating a detection beam traversing along said body between said end assemblies;

beam detector means for detecting the presence of a foreign object in said beam and generating a first signal indicative thereof.

2. The exit bar of claim 1 wherein said detection beam generator is an infrared beam.

3. The exit bar of claim 2 wherein said beam generator means comprises an infrared LED.

4. The exit bar of claim 2 wherein said beam detector means comprises a photo IC.

5. The exit bar of claim 1 further comprising:

capacitance sensor means for detecting a capacitance change in response to an external contact applied to said body and generating a second signal indicative thereof.

6. The exit bar of claim 1 further comprising:

alarm means disposed in said body for indicating when said beam detector means detects a foreign object in said beam for a time period greater than a preset time period.

7. The exit bar of claim 1 further comprising:

means for mounting said body to a door.

8. An emergency exit bar comprising:

an elongated housing, said housing defining an elongated frontal face and an elongated back panel oppositely located from said frontal face;

mounting means at said back panel for mounting said housing to a door so that said frontal face projects forwardly from said door;

beam generator means for generating a detection beam along said frontal face; and beam detector means for detecting the presence of a foreign object in said beam and generating a first signal indicative thereof.

9. The exit bar of claim 8 wherein said detection beam is an infrared beam.

10. The exit bar of claim 9 wherein said beam generator means comprises an infrared LED.

11. The exit bar of claim 8 further comprising:

capacitance sensor means for detecting a capacitance change in response to an external contact applied to said housing and generating a second signal.

12. The exit bar of claim 11 further comprising:

alarm means for generating a first alarm when said beam detector means detects a foreign object in said beam for a time period greater than a first preset time period, and generating a second alarm when said capacitance sensor means detects a capacitance change for a time period greater than a second preset time period.

13. The exit bar of claim 8 further comprising:

alarm means disposed in said housing for indicating when said beam detector means detects a foreign object in said beam for a time period greater than a preset time period.

14. The exit bar of claim 8 wherein said housing defines a first end and a second end, said beam generator means comprises a photo emitter and said beam detector means comprises a photo receiver, said exit bar further comprising:

a first end cap means at said first end of said housing for mounting said emitter at a position spaced forwardly from said frontal face; and a second end cap means at said second end of said housing for mounting said receiver at a position spaced forwardly from said frontal face.

15. The exit bar of claim 8 wherein said mounting means comprise insulated blocks.

16. An emergency exit bar system comprising:

an elongated tubular structure defining a frontal face;

capacitance sensor means for detecting a capacitance change in response to an external contact applied to said structure and generating a first signal indicative thereof;

beam generator means for generating a detection beam along said structure exteriorly of said structure and adjacent said face;

beam detector means for detecting the presence of a foreign object in said beam and generating a second signal; and relay means responsive to said first and said second signals for controlling the state of a lock in response to said signals.

17. The exit bar system of claim 16 further comprising:

electromagnetic lock means for electromagnetically securing and releasing a door in response to said relay means.

18. The exit bar system of claim 16 wherein said detection beam is an infrared beam.

19. The exit bar system of claim 16 further comprising:

alarm means for generating a first alarm when said beam detector means detects a foreign object in said beam for a time period greater than a first preset time period and generating a second alarm distinct from said first alarm when said capacitance sensor means detects a capacitance change for a time period greater than a second preset time period.

20. The exit bar of claim 19 wherein said first alarm comprises a series of sounds repeated at a first frequency; and said second alarm comprises a series of sounds repeated at a second frequency.

* * * * *